US006283706B1

(12) United States Patent
Cochran et al.

(10) Patent No.: US 6,283,706 B1
(45) Date of Patent: Sep. 4, 2001

(54) ADJUSTABLE HARNESS FOR A PORTABLE FAN

(75) Inventors: Marian Harding Cochran, Hollywood, FL (US); Peter T. Cobrin, Livingston, NJ (US); Robert J. Hess, New York, NY (US)

(73) Assignee: Atico International USA, Inc., Ft. Lauderdale, FL (US)

( * ) Notice: Subject to any disclaimer, the term of this patent is extended or adjusted under 35 U.S.C. 154(b) by 0 days.

(21) Appl. No.: 09/414,263

(22) Filed: Oct. 7, 1999

(51) Int. Cl.[7] ..... F04D 29/64

(52) U.S. Cl. ..... 416/63; 416/146 R; 416/244 R; 416/247 R

(58) Field of Search ..... 416/63, 146 R, 416/244 R, 246; 24/16 PB, 129 W, 115 G; 454/370; 224/258, 268

(56) References Cited

U.S. PATENT DOCUMENTS

| | | | | |
|---|---|---|---|---|
| 301,294 | * | 1/1884 | Smith et al. | 24/129 W |
| 1,504,003 | | 8/1924 | Trumbull . | |
| 2,100,088 | * | 11/1937 | Robertson | 224/258 |
| 2,572,889 | | 10/1951 | Strykower . | |
| 2,710,338 | | 6/1955 | Svalgaard . | |
| 3,225,982 | | 12/1965 | Melton . | |
| 3,927,445 | * | 12/1975 | Pavlish | 24/161 |
| 4,881,302 | * | 11/1989 | Lee | 24/155 G |
| 5,304,035 | | 4/1994 | Carter . | |
| 6,135,714 | * | 10/2000 | Hsu | 416/63 |

* cited by examiner

*Primary Examiner*—Edward K. Look
*Assistant Examiner*—Richard Woo
(74) *Attorney, Agent, or Firm*—Cobrin & Gittes

(57) ABSTRACT

A portable apparatus that includes fan and a harness adapted to permit the fan to be hung from a harness in a self-supported position on the wearer and which permits relocation of the fan to vary the distance of the fan from the neck of the wearer. The harness includes a cord that is looped about the wearer's neck and which passes through an adjustable coupler, whose sidewalls are configured and arranged to deform in response to squeezing forces. In response to the sidewalls being squeezed, the adjustable coupler releases the cord to permit simultaneous relative movement of the adjustable coupler along the cord. In response to removal of the squeezing forces, the adjustable coupler resiliently returns to its undeformed condition, grasping the cord to prevent relative movement of the adjustable coupler.

18 Claims, 3 Drawing Sheets

ADJUSTABLE HARNESS FOR A PORTABLE FAN

BACKGROUND OF THE INVENTION

1. Field of the Invention

The invention relates generally to an adjustable harness for an air cooling fan such as a personal portable fan that is worn by the user.

2. Discussion of Related Art

Conventional cooling fans are generally situated at fixed locations in a room. The conventional fans, however, can only cool the area near the front of the fan blade. Thus, the actual region cooled depends on the fan blade diameter, the power and speed of the fan motor, the angle of oscillation, and other factors. A user of a fixed location conventional fan must, therefore, remain in this limited region to be cooled by the fan.

The conventional fan also requires an electrical power source for operation such as an AC power line or a battery. As an alternative to fixed location conventional cooling fans, portable cooling fans, also referred to as personal fans, are generally battery operated and are of lightweight construction. The portable fan, however, requires manual holding during operation or, alternatively, must be set in a holder that sits upon a rigid surface.

If the fan is hand held while operating, the user's hand is not free for other purposes and cannot carry out any tasks requiring both hands. In addition, if the user desires the benefit of cool air for a prolonged period, the user must occasionally switch hands to avoid muscle tetanus which likewise may interfere with other tasks. Further, the use of hand held fan is unavailable to segments of the population that suffer from a handicap affecting use of one or both of the arms or hands.

Alternatively, the user may set the personal fan in a stand, thereby losing the benefit of portability. The user must now remain within the limited region cooled by the fan to benefit from the fan's cooled air currents.

U.S. Pat. No. 5,304,035, ("the '350 patent"), entitled "Portable Necklace Fan", is directed to a portable fan worn in a manner that directs air upwardly toward the wearer's face without being manually held. The fan is supported by a cord worn around the user's neck that supports the fan in an orientation such that air is directed upwards toward the wearer. The cord of the fan of the '035 patent is directly attached to either the housing or the shroud of the fan, namely the part of the fan that encloses the fan blades, and loops about the neck to permit its loose ends to be fastened together.

It is desirable to provide a replaceable support for a portable fan and which is not directly connected to the shroud or any other portion that covers or encases the fan blades.

It is additionally desirable to provide a relatively simple way to modify the position and distance between the fan blades and the targeted area to be cooled, e.g., the face of the wearer.

It is still further desirable to provide a support that is easy to detangle and does subject the fan motor and housing to rapid turning during detangling.

It is yet further desirable to provide a relatively simple mechanism to change the support as desired by the wearer, such as by replacing an ordinary cord or string with a flourescent support material for night use or, alternatively, using an alternative fashionable support.

SUMMARY OF THE INVENTION

The present invention provides a portable apparatus that includes fan and a harness adapted to permit the fan to be worn in a self-supported position on the wearer and which permits relocation of the fan to vary the distance of the fan from the neck of the wearer. The harness includes a cord that is looped about the wearer's neck and which passes through an adjustable coupler. The coupler is configured to secure the cord against relative movement while the coupler is in a relaxed condition and release the cord to permit relative movement while the coupler is in a squeezed condition when squeezed between two fingers of the wearer. Instead of securing the cord to the fan housing or protective shroud that encases the fan blades, the cord passes through a passage in a bead and a separate line is secured to the fan housing or protective shroud. The line also passes through the passage in the bead. If desired, the bead may be dispensed with by crossing the line and cord with each other instead.

Other features and advantages of the present invention will become apparent from the following detailed description of the invention with reference to the accompanying drawings.

DETAILED DESCRIPTION OF THE INVENTION

Figure 1:
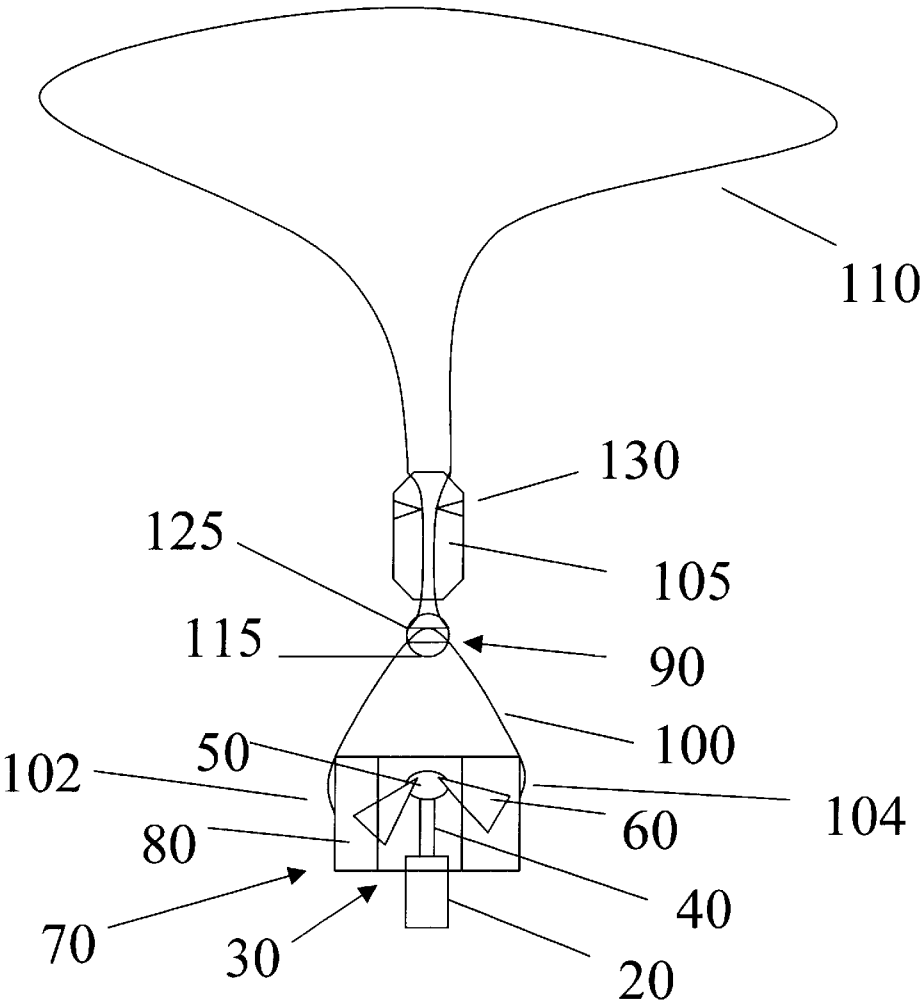
FIG. 1 is a schematic diagram showing an adjustable harness and a portable fan.

Turning to the drawings, FIG. 1 shows the portable fan assembly 10 according to an embodiment of the present invention. The portable fan assembly 10 includes a housing 20 that encloses a lightweight motor (not shown). The lightweight motor is preferably powered by a rechargeable or disposable battery (not shown), though other suitable portable power sources may be used. Also provided is an air current generator 30 comprised of the motor, an axle 40 rotatably connected to the lightweight motor within the housing 20, a hub 50 mounted on the axle 40, and a plurality of blades 60 that project outwardly from the hub 50. A protective shroud 70 partially surrounds the air current generator 30 and serves as a protective barrier between the blades 60 and the wearer of the portable fan 10.

The motor, when powered-up, turns the axle 40 which, in turn, rotates the hub 50 and blades 60 to create a current of moving air. The protective shroud 70 includes one or more openings 80 which allow the air currents generated by the air current generator 30 to travel upwardly to a target area, such as toward the face of the wearer.

A harness is provided to permit the fan to hang from the wearer at a desired location. The harness includes a fan support that has a bead 90 and a line 100 having two ends 102, 104 connected to the housing 20 or to the protective shroud 70, preferably to opposite sides of the housing 20 or protective shroud 70. The two ends 102, 104 of the line 100 may be connected through a slit or other molded projection of the housing or protective shroud or may be connected via metal or plastic rings, though other types of connectors well known in the art may be used. Alternatively, the line 100 may be integral with the housing 20 or the protective shroud 70. The line 100 is preferably formed from a flexible, rigid or flexibly rigid material.

The harness also includes an adjustable coupler 105, a looped cord 110. The looped cord 110 extends through a chamber 120 in the adjustable coupler 105 and through a passage 125 defined by the body 115 of the bead 90. The line 100 also passes through this same passage 125. The bead 90 has a diameter at least as large as the diameter of the opening to the chamber 120 in the adjustable coupler 105 to prevent the bead from inadvertently being pulled through the chamber 120. The line 100 and the cord 110 may be comprised of a rope, a band, a string, a cable, a wire or a link chain that is worn around the neck of the user.

Two inwardly projecting elements, such as teeth 130, extend inwardly from the respective sidewalls toward each other inwardly of the chamber 120. The teeth may be blunt instead of sharp and thus truncated instead of pointed, although they preferably taper.

Figure 2:
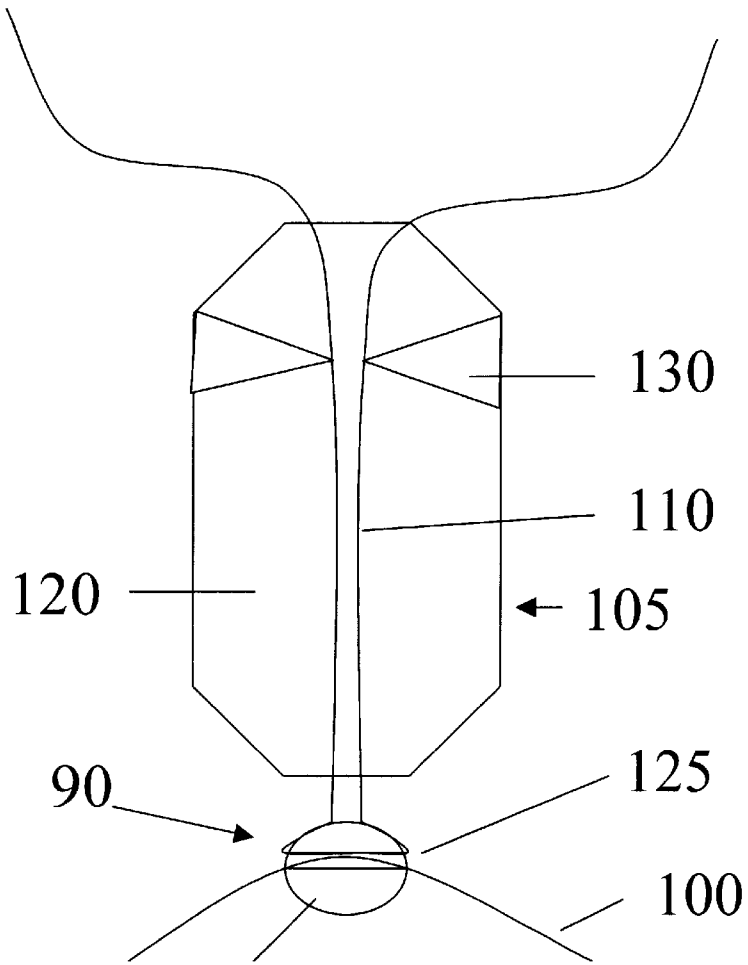
FIG. 2 is a schematic diagram showing a coupler of the adjustable harness of FIG. 1 in a relaxed condition, securing a cord.

When the adjustable coupler 105 is in a relaxed position such as that shown in FIG. 2, the teeth 130 define a gap between that is sufficiently close to pinch or squeeze the portions of the cord 110 passing between the teeth 130 so as to prevent the cord 110 from moving relative to the adjustable coupler 105. As a result, the size of the loop circumference formed by the cord 110 remains fixed as the teeth secure the cord 110, despite the weight forces of the fan acting on the body 115 and coupler 105.

Figure 3:
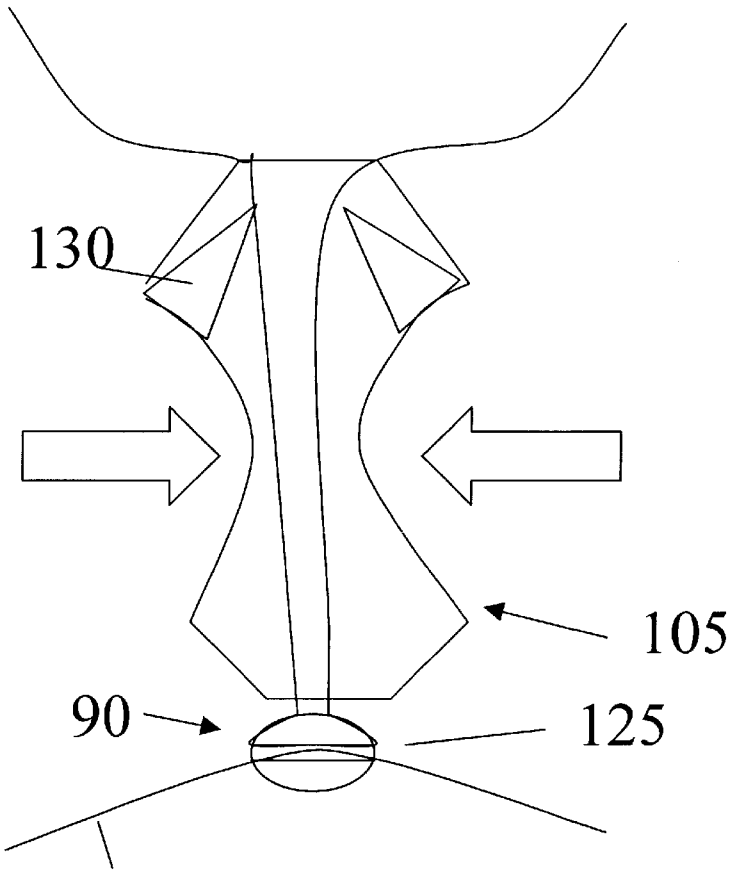
FIG. 3 is a schematic diagram of the coupler of FIG. 2 except in a compressed condition, releasing the cord.

When the adjustable coupler 105 is in a squeezed condition of FIG. 3, however, the teeth spread further apart from each other than was the case in the relaxed condition of the adjustable coupler of FIG. 2. This situation arises because the ends of the adjustable coupler are more rigid than the sidewalls so that the sidewalls arc or bow, with the center region of the sidewalls coming closer together than at the at the connection areas with the ends.

As a consequence, the teeth 130 change their orientation in conformance with the curvature of the sidewalls so that their inward ends point toward one end of the adjustable coupler as opposed to pointing across from each other as in the relaxed condition.

The cord 110 is thus freed from the teeth 130 to permit adjustment of the adjustable coupler 105 relative to the bead 90 along the cord 110 by simply sliding it in either longitudinal direction, so as to vary the size of the loop of the cord as desired. Once such a desired position is reached, the wearer stops squeezing and the resilient forces of the coupler 105 that tend to return the sidewalls to their non-squeezed condition are sufficient to position the teeth back into a position where they secure the cord against relative movement.

The coupler 105 is preferably made of a material having elastic memory characteristics such as rubber or pliable plastic whose sidewalls may be readily squeezed inwardly to compress the chamber 120. The ends of the coupler 105, however, are made of a more rigid construction so as to better retain their shape while the sidewalls are being squeezed and accommodate movement of the teeth 130 away from each other.

The movement of the adjustable coupler 100 allows for altering the distance between the fan housing 20 and the cooled area, such as the face of the wearer. Specifically, the wearer can simply slide the adjustable coupler 100 to the desired location by simultaneously squeezing it and then releasing it when the desired location is reached. Since the weight of the fan should be sufficient to keep the end of the cord 110 in position, the adjustment is essentially a one hand operation. Nevertheless, the bead 90 may be grasped by the other hand if necessary to keep the end of the cord stationary while adjusting the relative position of the coupler 100. The relative movement of the coupler 100 with respect to the bead 90 will alter the size of the circumference of the loop formed by the cord 110.

Figure 4:
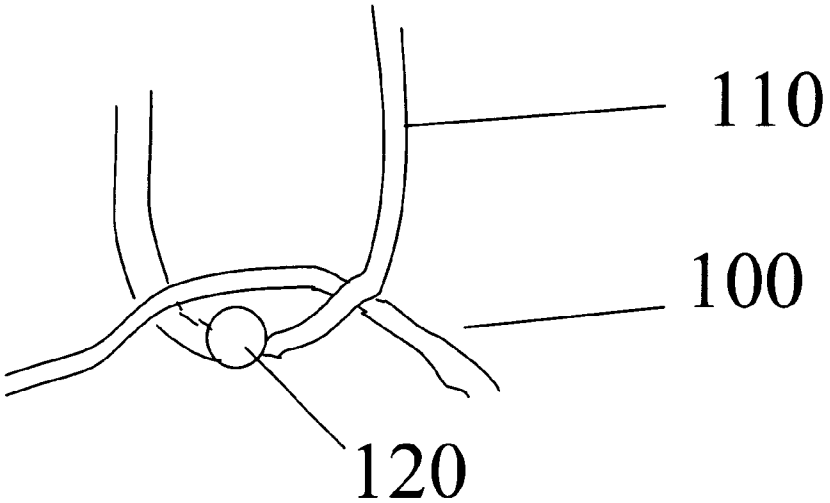
FIG. 4 is a schematic diagram of a knot in a cord that is crossed by a line whose ends are attached to a fan.

As an alternative as shown in FIG. 4, the line 100 may be crossed with the loop of the cord 110 instead of passing through the bead 90. Thus, adjustment of the size of the loop of the cord 110 would arise by moving the adjustable coupler relative to the bead 90 near the back of the neck of the wearer. Further, the bead 90 may be dispensed with entirely and replaced by a knot 120 formed in the cord and sized so that the knot does not pass through the passage in the adjustable coupler.

While the foregoing description and drawings represent the preferred embodiments of the present invention, it will be understood that various changes and modifications may be made without departing from the spirit and scope of the present invention. It is preferred, therefore, that the present invention be limited not by the specific disclosure herein but only by the appended claims.

What is claimed is:

1. A portable apparatus, comprising:

a fan having rotary blades and a frame that encloses the rotary blades, the fan being configured to be operative to rotate the rotary blades to generate air flow through openings in the frame;

an adjustable coupler and a cord, the adjustable coupler having a chamber, the cord having two spaced apart portions within the chamber and forming a loop between the two spaced apart portions, the adjustable coupler being configured to enable relative movement through a plurality of relative positions along the cord while being squeezed under manual force and being configured to grasp the two spaced apart portions in response to the manual force being released to prevent the relative movement; and a fan support having at least one support component, the cord being mounted to the support component, the fan support being arranged to support the fan while the loop hangs from a user's neck with the support component positioned between the frame and the adjustable coupler.

2. A portable apparatus as in claim 1, wherein the fan includes a hub, the rotary blades extending outwardly from the hub, the fan also having a motor operatively connected to rotate the blades and that has a housing, and the fan support having a line held by the support component, the line having two ends each attached to one of the housing and the frame.

3. The apparatus as in claim 1, wherein the support component is a bead element having a passage, the fan support further including a line secured to the fan, at least one of the cord and line extending through the passage, the other of the cord and line being secured to the bead.

4. The apparatus of claim 1, wherein said adjustable coupler has sidewalls and has projecting elements whose ends are directed further inward of said chamber than said sidewalls, said sidewalls being bendable in response to being squeezed by the manual force to define a curvature, said projecting elements being spaced from the central area of the curvature so that as said sidewalls progressively bend inwardly in response to being squeezed by the manual force, said ends of said projecting elements move in unison with said sidewalls to spread further apart from each other to move from a position that prevents the relative movement by grasping the cord to a position that enables the relative movement by freeing the cord.

5. The apparatus as in claim 4, wherein the projecting elements are tapered.

6. The apparatus as in claim 1, wherein the support component is a bead element having a passage, the fan support further including a line secured to the fan, the cord and the line each extending through the passage.

7. A portable apparatus as in claim 1, wherein the support component is a bead element having a passage, the cord having a portion within the passage.

8. A portable apparatus as in claim 1, wherein the support component is a knot in the cord, further comprising a line crossing the cord and having two ends secured to the fan.

9. A portable apparatus as in claim 1, wherein the support component is a bead element having a passage, the cord being secured to the bead element, further comprising a line separate from the cord, the line having a portion within the passage and having two ends each attached to the fan.

10. An apparatus as in claim 1, wherein the adjustable coupler has sidewalls that deform from a relaxed condition to a deformed condition in response to being squeezed from the manual forces and that have elastic memory characteristics to resiliently return to the relaxed condition in response to removal of the manual forces.

11. An apparatus as in claim 1, wherein the fan support includes two spaced apart attachment locations that are spaced from the support component with each at a respective opposite side of the fan.

12. A method of adjusting a relative position of a fan, comprising hanging a loop of a cord around a wearer's neck, the loop being defined between to spaced apart portions of the cord that are within an adjustable coupler, mounting the cord to a support component of a fan support, supporting a fan with the support component, sliding the adjustable coupler along the cord through a plurality of relative positions while squeezing the adjustable coupler under manual force, releasing the manual force to grasp the two spaced apart portions with the adjustable coupler and thereby prevent further relative movement of the adjustable coupler while the manual force is released, and positioning the support component between the adjustable coupler and a frame that encloses rotary fan blades of the fan, the fan being operative to generate air flow through openings in the frame.

13. A method as in claim 12, comprising connecting two ends of a line to one of said housing and said frame, the support component having a passage; passing at least one of the cord and the line through the passage in the support component.

14. A method as in claim 12, wherein the squeezing and sliding of the adjustable coupler is carried out with only one hand of the wearer by using the weight of the fan to keep the cord steady so as to avoid the need to use the other hand to keep the cord steady.

15. A method as in claim 12, wherein the releasing is carried out by exerting the manual forces on sidewalls of the adjustable coupler so as to deform a configuration of the sidewalls from a relaxed condition to a deformed condition, the grasping being carried out by removing the manual force to permit the sidewalls to resiliently return to the relaxed condition and to secure the cord in the chamber while the sidewalls are in the relaxed condition.

16. A method as in claim 15, wherein the adjustable coupler has teeth on an interior of the sidewalls, the teeth engaging the cord while the sidewalls are in the relaxed condition, the teeth being moved out of engagement of the cord in response to deforming the sidewalls.

17. A method as in claim 12, further comprising attaching a line to the fan and supporting the line with the support component.

18. A method as in claim 12, further comprising attaching a line to the fan and crossing the cord with the line.

* * * * *